US010112096B1

(12) United States Patent
Taylor et al.

(10) Patent No.: US 10,112,096 B1
(45) Date of Patent: Oct. 30, 2018

(54) HOCKEY TRAINING DEVICE

(71) Applicant: Steven Taylor, Toronto (CA)

(72) Inventors: Steven Taylor, Toronto (CA); Robert G. Dickie, King City (CA)

(73) Assignee: Steven Taylor, Toronto, Ontario (CA)

( * ) Notice: Subject to any disclaimer, the term of this patent is extended or adjusted under 35 U.S.C. 154(b) by 0 days.

(21) Appl. No.: 15/717,466

(22) Filed: Sep. 27, 2017

(51) Int. Cl.

| | |
|---|---|
| ***A63B 69/00*** | (2006.01) |
| ***A63B 59/14*** | (2006.01) |
| *A63B 59/70* | (2015.01) |
| *A63B 102/24* | (2015.01) |
| *A63B 102/22* | (2015.01) |

(52) U.S. Cl.
CPC ..... *A63B 69/0026* (2013.01); *A63B 59/70* (2015.10); *A63B 2102/22* (2015.10); *A63B 2102/24* (2015.10); *A63B 2225/093* (2013.01)

(58) Field of Classification Search
CPC ..... A63B 69/0026; A63B 2225/093; A63B 59/70; A63B 2102/22; A63B 102/24; A63B 2225/09
USPC ..... 473/560–563, 446, 437, 328, 228, 473/518–520, 594; D21/727
See application file for complete search history.

(56) References Cited

U.S. PATENT DOCUMENTS

| | | | | |
|---|---|---|---|---|
| 2,072,682 A * | 3/1937 | Morgan | A63B 67/002 | 473/515 |
| 3,128,119 A | 4/1964 | Walter | | |
| 3,720,410 A * | 3/1973 | Saytar | A63B 59/70 | 473/562 |
| 3,809,401 A * | 5/1974 | Hankele | A63B 59/70 | 473/560 |
| 3,844,555 A * | 10/1974 | Tremblay | A63B 59/00 | 473/563 |
| 4,340,224 A * | 7/1982 | Staats | A63B 60/50 | 473/563 |
| 4,343,468 A * | 8/1982 | Lindgren | A63B 59/70 | 473/563 |
| 4,767,092 A | 8/1988 | Weatherly | | |
| 5,538,166 A | 7/1996 | Ogawa et al. | | |
| 5,980,404 A * | 11/1999 | Gentile | A63B 69/0024 | 473/560 |
| 6,273,835 B1 * | 8/2001 | Battis | A63B 60/50 | 473/563 |
| 6,926,629 B2 * | 8/2005 | Dehen | A47L 13/00 | 473/563 |
| 7,410,432 B2 * | 8/2008 | Dehen | A47L 13/00 | 473/563 |

(Continued)

*Primary Examiner* — Mitra Aryanpour
(74) *Attorney, Agent, or Firm* — Sand & Sebolt

(57) ABSTRACT

A hockey training device and method of using the same to teach a hockey player how to play a shot, particularly a wrist shot. The device includes a connector assembly that is selectively engaged with a hockey stick blade during training; a puck holding assembly for holding the puck in an optimum position; and a hinge connecting the connector assembly and puck holding assembly together. The hinge allows the connector assembly and puck holding assembly to pivot relative to each other as the stick is maneuvered to make a shot. The puck holding assembly includes a flexible region that is moved out of the way of the puck as a shot is played and the puck is accelerated by the stick toward a net or another player. The hinge ensures that the puck holding assembly maintains its position relative to the ice as the shot is played.

28 Claims, 18 Drawing Sheets

(56) References Cited

U.S. PATENT DOCUMENTS

| | | | | |
|---|---|---|---|---|
| 8,231,486 | B2 * | 7/2012 | Neufeld | A63B 59/70 473/563 |
| 2009/0253537 | A1 | 10/2009 | Bremner | |
| 2009/0264229 | A1 * | 10/2009 | Forsberg | A63B 67/002 473/563 |
| 2012/0083370 | A1 * | 4/2012 | Girsky | A63B 60/00 473/563 |
| 2012/0236543 | A1 | 9/2012 | Torgerson | |
| 2014/0094329 | A1 | 4/2014 | Taylor | |

* cited by examiner

HOCKEY TRAINING DEVICE

BACKGROUND

Technical Field

Generally, the current disclosure relates to a training device. More particularly, the current disclosure is directed to a training device that is used in conjunction with a hockey stick and which can be used to teach hockey players how to properly capture, control, and shoot pucks. Specifically, the training device includes a connector assembly that engages the blade of a hockey stick and a puck holding assembly that is engaged with the connector assembly by a hinge.

Background Information

Young ice hockey players need to learn to correctly control and shoot a hockey puck. Most young hockey players naturally try to keep the puck near the toe of the stick blade and try to shoot the puck by moving the stick forwardly and using the toe. One of the most difficult shots to learn to do properly is a wrist shot. This type of shot is difficult to learn because the player has to deal with many different sequences in a short time frame. The proper way to make the wrist shot is to keep the puck near the heel of the hockey stick blade and to shoot the puck using force generated by the player's wrist. This technique is not easily mastered.

A number of training devices have been proposed in the prior art to help young players learn how to correctly position the stick blade when playing shots such as wrist shots. One of these proposed devices is disclosed in US Publication No, 2014/0094329 to Taylor. Taylor discloses a hockey training aid that includes a resilient plastic member which is mounted to the hockey stick blade. The plastic member includes a curved plastic web having a middle portion mounted to the hockey stick blade and first and second arms projecting from the middle portion in opposite directions. The puck is captured between the first and second arms. The middle portion of the training device is engaged with the blade by a J-shaped hook that is fixedly secured to the middle portion of the plastic member. The J-shaped hook passes over the top edge of the blade and suspends the curved web next to a face of the blade. When the Taylor device is engaged with a hockey stick blade and the stick is moved so that it assumes a rearward angle, the training device will tend to cause the blade to lift off the ice as the shot is played. This tendency to lift the blade off the ice interferes with the shot and the device is therefore less effective in training young players.

SUMMARY

There is therefore a need in the art for a training device that may aid hockey players in learning shots like the wrist shot and therefore will aid in improving their shooting skills.

The current disclosure relates to a hockey training device that addresses some of the shortcomings of the prior art. A hockey training device and method of using the same to teach a hockey player how to play a shot, particularly a wrist shot. The device includes a connector assembly that is selectively engaged with a hockey stick blade during training; a puck holding assembly for holding the puck in an optimum position and a hinge connecting the connector assembly and puck holding assembly together. The hinge allows the connector assembly and puck holding assembly to pivot relative to each other as the stick is maneuvered to make a shot. The puck holding assembly includes a flexible region that is moved out of the way of the puck as a shot is played and the puck is accelerated by the stick toward a net or another player. The hinge ensures that the puck holding assembly maintains its position relative to the ice as the shot is played.

In one aspect, the current disclosure may provide a hockey training device comprising a connector assembly adapted to engage a blade of a hockey stick, and a puck holding assembly operably engaged with the connector assembly, and wherein the puck holding assembly is movable relative to the connector assembly.

In another aspect, the current disclosure may provide a method of training a hockey player using a hockey training device, said method comprising steps of providing a hockey stick having a handle and a blade, providing a hockey training device comprising a connector assembly and a puck holding assembly movably engaged with the connector assembly, placing the connector assembly on the blade of the hockey stick, extending the puck holding assembly outwardly from a first face of the blade, capturing a hockey puck in the puck holding assembly, playing a shot with the hockey stick, pivoting the puck holding assembly relative to the connector assembly as the shot is played, and releasing the hockey puck from the puck holding assembly.

In another aspect, the current disclosure may provide a combination of a hockey stick and a hockey training device, wherein the hockey stick includes a blade at an end of a handle; wherein the blade has a first face and an opposed second face; and wherein the hockey training device comprises a connector assembly and a puck holding assembly operably engaged with the connector assembly; wherein the connector assembly is engaged with the blade of the hockey stick; and wherein the puck holding assembly is movable relative to the connector assembly.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

The present disclosure relates to a hockey training device that assists hockey players to practice wrist shots by using the device which simply can be mounted onto a hockey stick blade.

Figure 1:
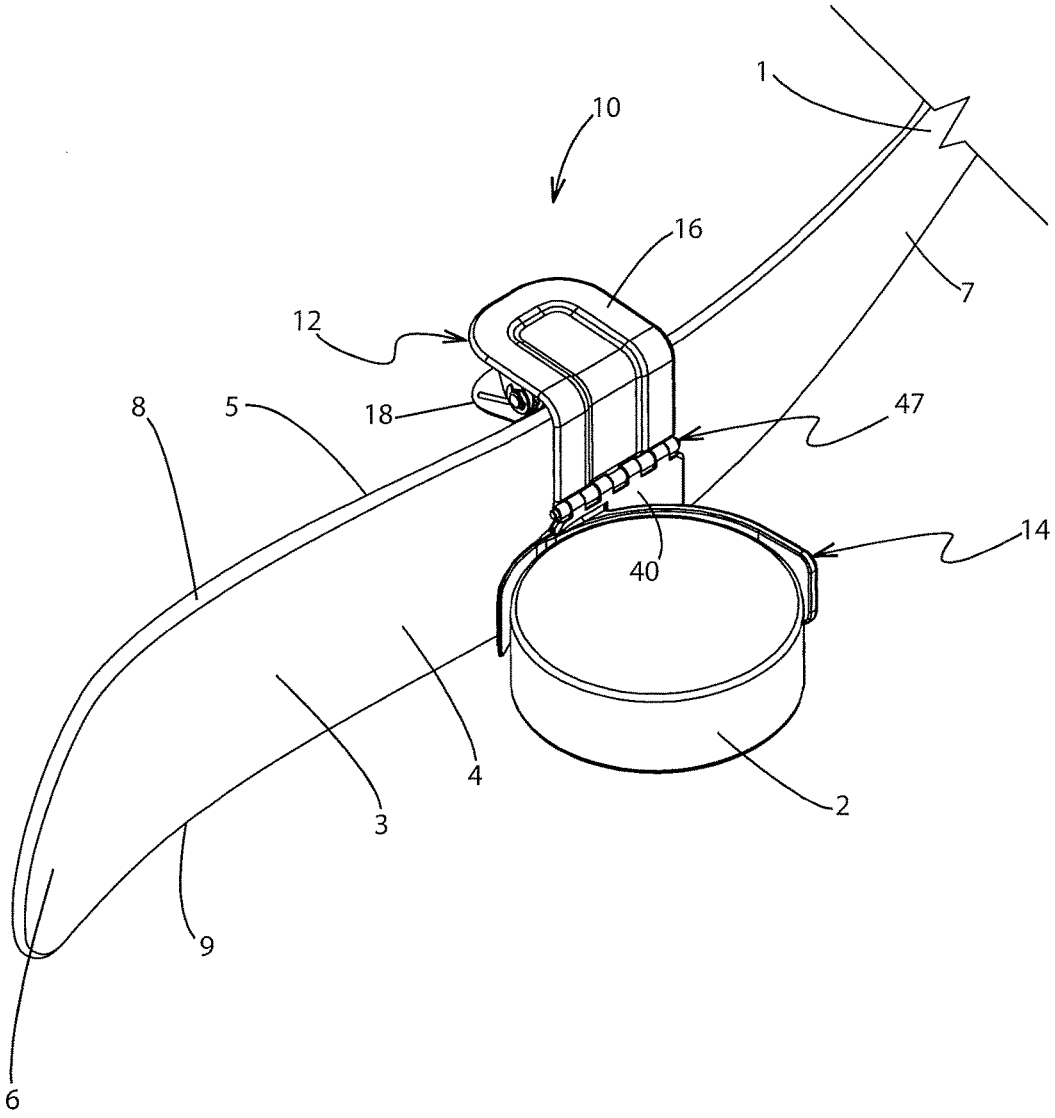
FIG. 1 is a top perspective view showing a first embodiment of a hockey training device in accordance with the present disclosure shown engaged on a hockey stick for a right handed player.

FIG. 1 is an exemplary view of a first embodiment of a hockey training device 10 engaged with a hockey stick 1. The hockey stick 1 includes a blade 3 which has a first blade 3 and a second face 5 extending from a toe 6 to a heel 7. Blade 3 further comprises a top edge 8 and a bottom edge 9. As shown in FIG. 1, hockey training device 10 may be engaged over top edge 8 of blade 3 to capture a hockey puck 2.

Figure 2:
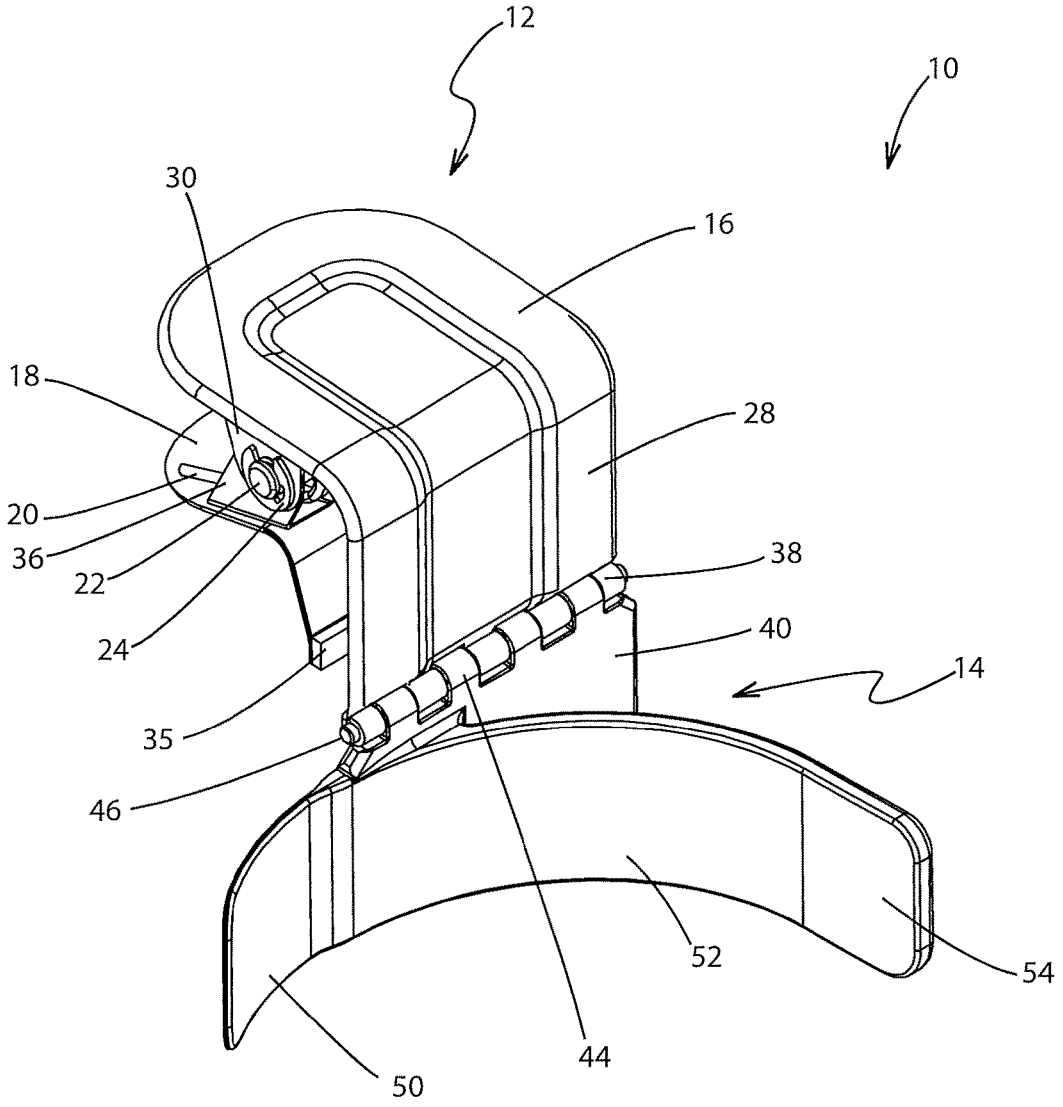
FIG. 2 is a top perspective view of the first embodiment of the hockey training device shown on its own.
Figure 4:
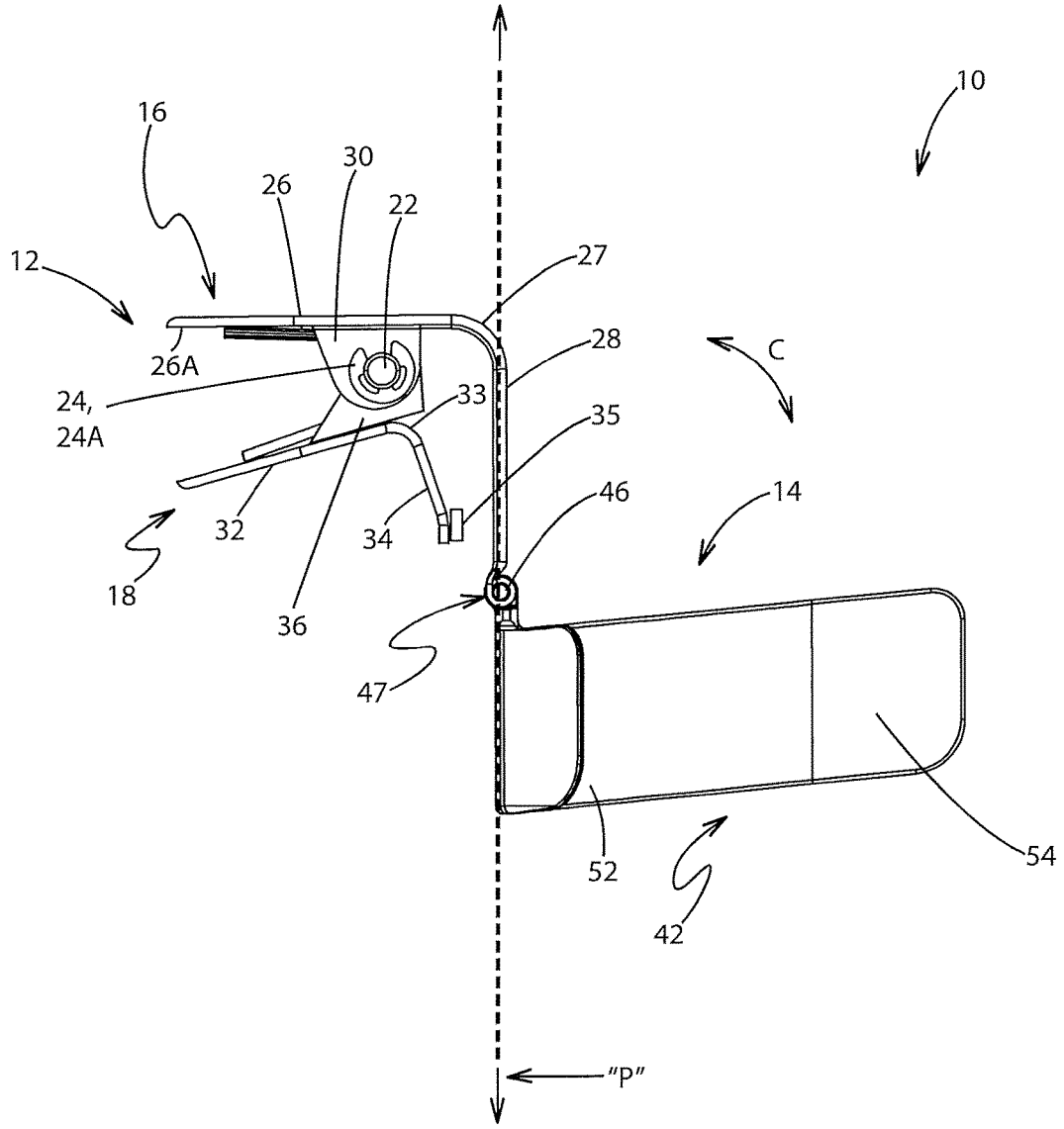
Figure 5:
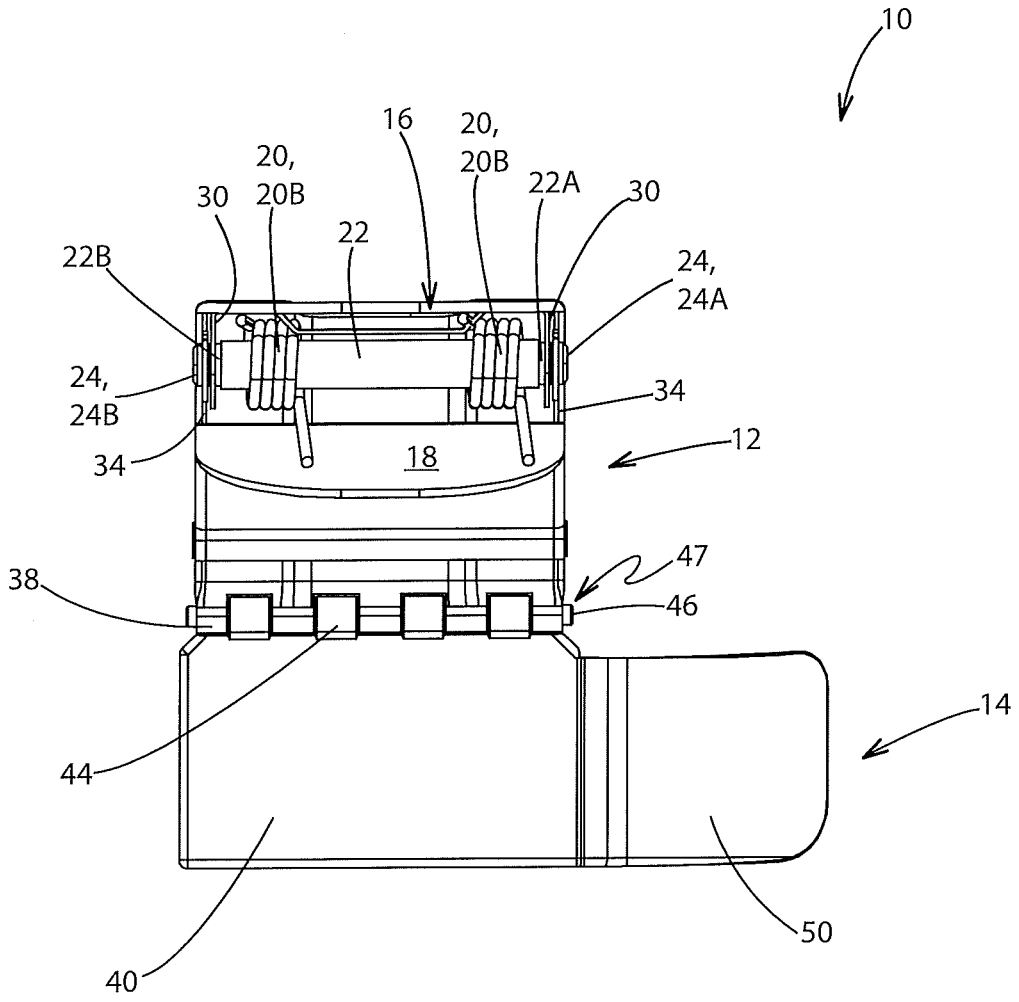
Figure 6:
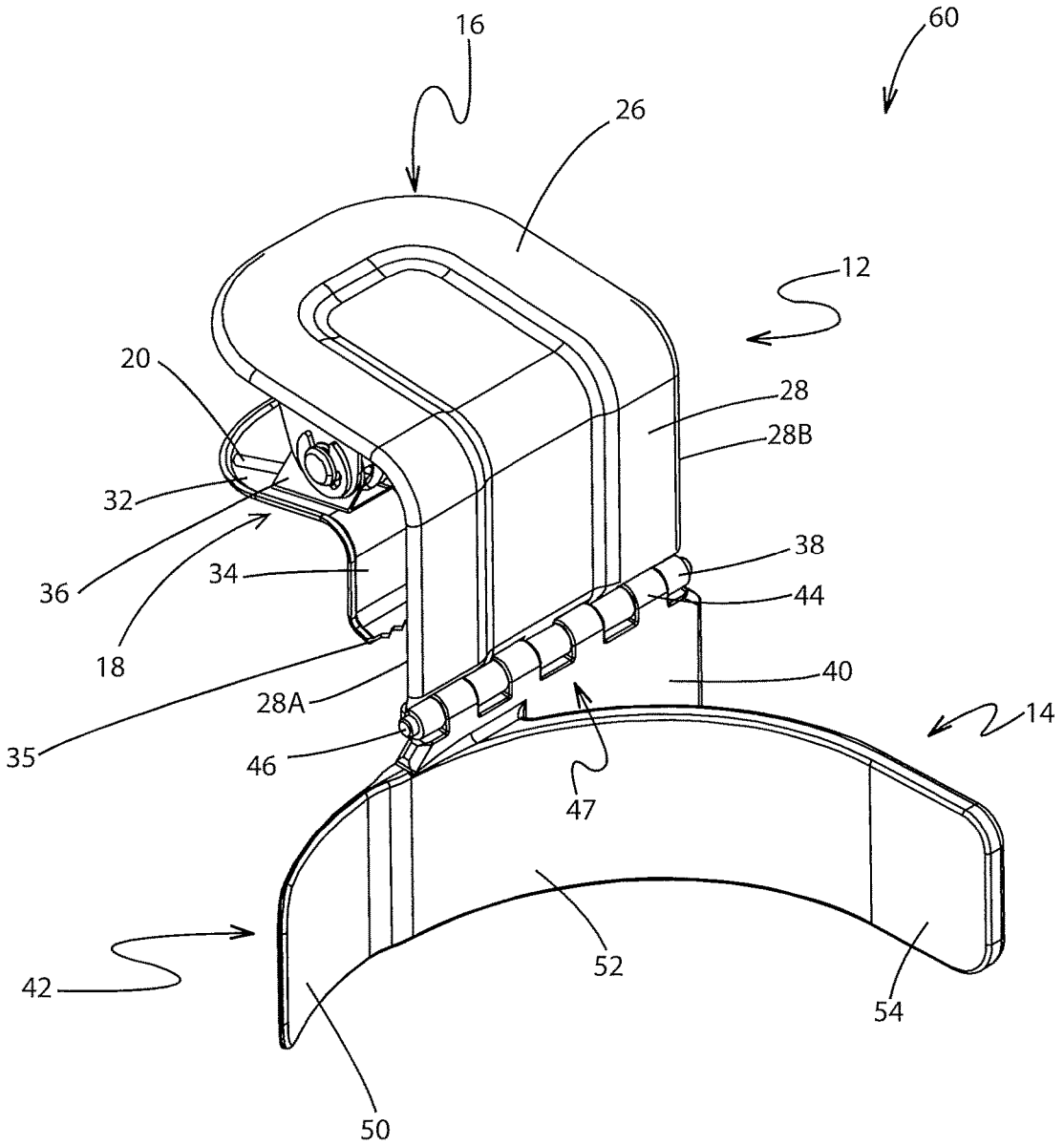
FIG. 6 is a top perspective view of a second embodiment of a hockey training device in FIG. 2 showing the connector assembly having projections thereon.

As depicted in FIGS. 2, 4, and 6, hockey training device 10 comprises a connector assembly 12 and a puck holding assembly 14 that is movably engaged with connector assembly 12 via a hinge 44. As illustrated, connector assembly may comprise a clamp (hereafter referenced by the number 12). Clamp 12 comprises a first L-shaped bracket 16, a second L-shaped bracket 18, one or more torsion springs 20, a pin 22, and a set of C-shaped lock washers 24. As shown in FIG. 4, first L-shaped bracket 16 may comprise a first leg 26 and a second leg 28 that may be oriented at right angles to each other. The first leg 26 may include a set of mounting brackets 30 that extend downwardly from a bottom surface 26A of first leg 26. The second L-shaped bracket 18 further comprises a first arm 32 and a second arm 34 that may be oriented at right angles relative to each other. Second bracket 18 may be nested inside first bracket 16 as shown FIG. 4. A corner 27 where first leg 26 and second leg 28 of first L-shaped bracket 16 meet may be rounded. Similarly, a corner 33 where first arm 32 and second arm 34 of second L-shaped bracket 18 meet may be rounded as well. As shown in FIGS. 2 and 6, second L-shaped bracket 18 may include a set of mounting brackets 36 provided on a top surface 32A of first arm 32 which engage a region of torsion springs 20. As shown in FIG. 5, pin 22 may be inserted through the center of two torsion springs 20 and each end of pin 22 may be inserted into an aperture defined in one of mounting brackets 30. Lock washers 24 engage pin 22 to secure pin 22 in mounting brackets 30. A first spring 20A may be located near a first end 22A of pin 22, and a second spring 20B may be located near a second end 22B of pin 22. Torsion springs 20 permit movement of second bracket 18 relative to first bracket 16. In particular, torsion springs 20 urge second arm 34 of second bracket 18 towards second leg 28 of first bracket 16. When force is applied to move the free ends of first leg 26 and first arm 32 towards each other, then second arm 34 of second bracket 18 is moved away from second leg 28 and blade 3 of hockey stick 1 may be clamped between second arm 34 and second leg 28.

As shown in FIGS. 4 and 5, first and second spring 22A, 22B are engaged with first leg 26 of first L-shaped bracket 16 and first arm 32 of second L-shaped bracket 18. A first C-shaped lock washer 24A and a second C-shaped lock washer 24B (shown in FIG. 5) are fixedly attached to both ends of pin 22A, 22B (shown in FIG. 5) respectively. The pin 22 is inserted through the downwardly extending mounting brackets 30 and upwardly extending second arm 34 so that first L-shaped bracket 16 and second L-shaped bracket 18 can be rotatably connected through torsion springs 20.

As depicted in FIGS. 2 and 4, second arm 34 of second L-shaped bracket 18 includes a rubber grip 35 near end of second arm 34 so that rubber grip 35 can contact second face 5 of blade 3 of hockey stick 1. The rubber grip 35 provides secure clamping on blade 3 without damaging second face 5 of blade 3. Furthermore, a lower end of second leg 28 of first L-shaped bracket 16 includes a hinge member 38 extending a first side edge 28A of bracket 28 to a second side edge 28B of bracket 28.

Referring back to FIGS. 2 and 4, puck holding assembly 14 comprises a plate 40 and a cup assembly 42. Plate 40 includes a complementary hinge member 44 at a top of plate 40. The hinge members 38 of second leg 28 are connected with hinge members 44 of plate 40 using a pin 46 to form a mechanical hinge 47. Hinge 47 allows puck holding assembly 14 and connector assembly 12 to move relative to each other. Hinge 47 allows puck holding assembly 14 to pivot relative to plate 40, and vice versa, about an axis "A" (shown in FIG. 3) extending along pin 46. As shown in FIG. 4, pin 46 is aligned along a same plane "P" as plate 40. Pivotal motion of puck holding assembly 14 and connector assembly 12 is shown in FIG. 4 by an arrow "C". When clamp 12 is engaged with blade 3, second leg 28 of first L-shaped bracket 16 is oriented generally parallel to first face 4 of blade 3 of hockey stick 1 and pin 46 of hinge 47 is oriented generally parallel to second leg 28 of clamp 12.

Figure 3:
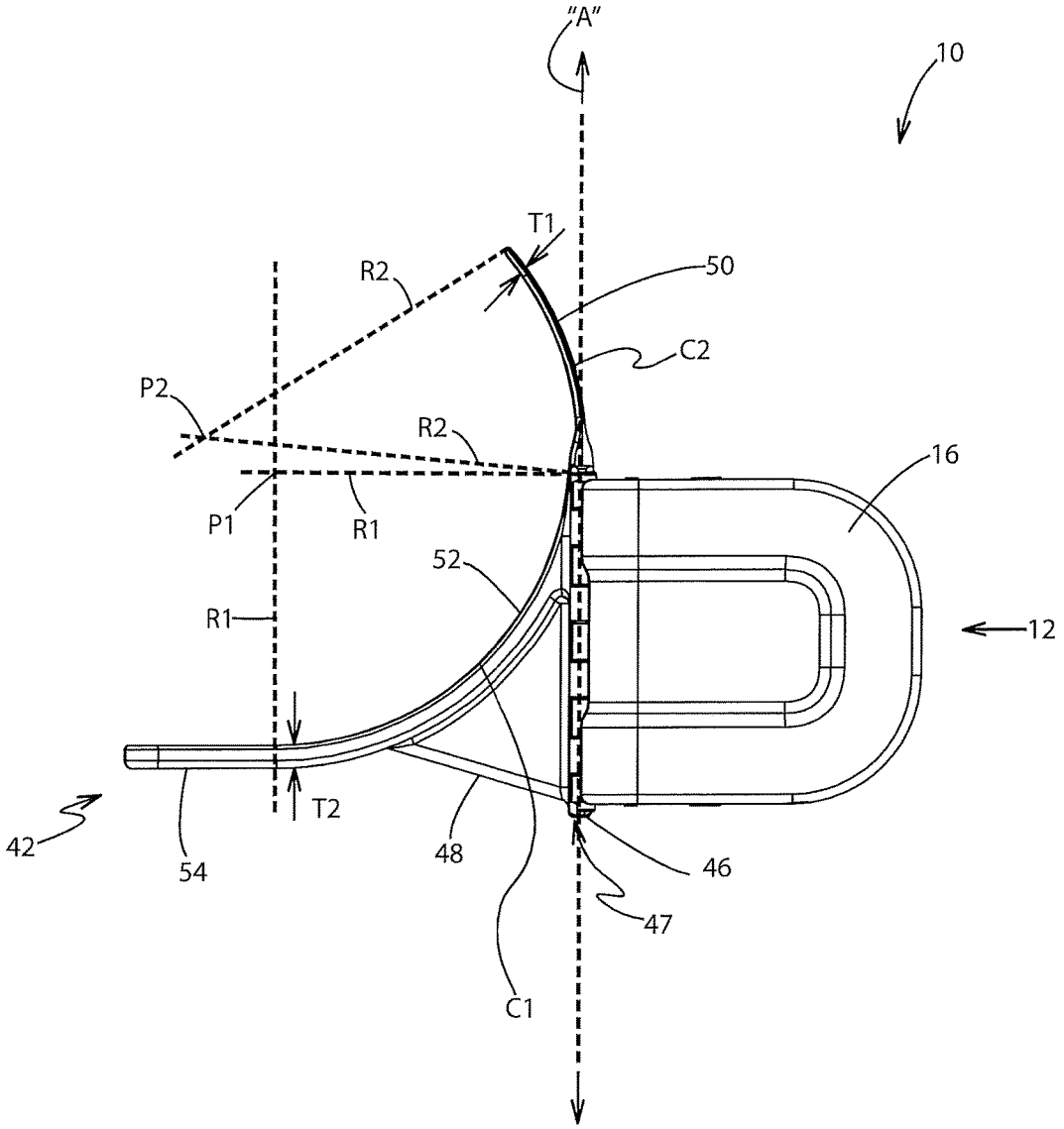
FIG. 3 is a top plan view of the hockey training device shown in FIG. 2, FIG. 4 a left side elevation view of the hockey training device shown in FIG. 2, FIG. 5 a rear elevation view of the hockey training device shown in FIG. 2.

As depicted in FIG. 3, plate 40 and cup assembly 42 are connected by a brace 48 thereof. The brace 48 is used to provide an additional support and strength to cup assembly 42 so that cup assembly 42 will be not distorted when receiving puck 2. The brace 48 helps to maintain the shape of cup assembly 42.

As shown in FIGS. 2 and 4, cup assembly 42 comprises a first section 50, a middle section 52, and a second section 54. First section 50 extends in a first direction forwardly of middle section 52 and second section 54 extends in a second direction rearwardly of middle section 52. Cup assembly 42 further includes a top edge 42A and a bottom edge 42B. Cup assembly 42 may be fabricated from a metal that is overmolded with a plastic. The plastic may be polypropylene as it is stiff enough if thick but fairly flexible if thin. Even though cup assembly 42 is made out of one piece of material such as plastic, first section 50 of assembly 42 is much thinner and more flexible than second section 54 of assembly 42. As extending from first section 50 of assembly 42 to second section of assembly 42, the thickness of cup assembly 42 increases and becomes more rigid. (The thickness is measured from an interior surface of the cup assembly 42 to an exterior surface thereof.) As shown in FIG. 3, first section 50 may have a thickness T1 and second section 52 may have a thickness T2. T2 is greater than T1. T2 may be around 0.070 inches thick, while T1 may be around 0.025 inches thick.

As seen in FIG. 3, which is viewed from the top, second section 54 of cup assembly 42 may be substantially straight. However, middle section 52 and first section 50 are concavely curved. Middle section 52 may have a radius of R1 from a first center point P1, and first section 50 may have a radius of R2 about a second center point P2 so that a first curvature C1 of middle section 52 may be different than a second curvature C2 of first section 50. The second curvature C2 may be relatively smaller than first curvature C1. Moreover, radius R2 of first section 50 may be longer than radius R1 of middle section 52.

Referring back to FIGS. 10 and 12 which show a left side elevation view of device 10, top edge 42A of cup assembly 42 is oriented at an angle $\alpha$ relative to second leg 28 of clamp 12. The angle $\alpha$ may be an acute angle. The bottom edge 42B of cup assembly 42 may be oriented at an angle $\theta$ relative to ice "I". The angle $\alpha$ may change in size as hockey stick 1 is used (this will be described later herein). The angle $\theta$ may remain generally the same size when hockey stick 1 is used.

FIG. 6 shows a second embodiment of hockey training device 60. The hockey training device 60 is substantially identical to device 10 in structure and function except that rubber grip 35 is replaced with a plurality of projections 36 that will engage blade 3. Projections 36 may be fabricated of a softer material so that they will tend not to damage blade 3 or any tape that may be wrapped around the blade. The tape is not shown in the attached figures.

Figure 7:
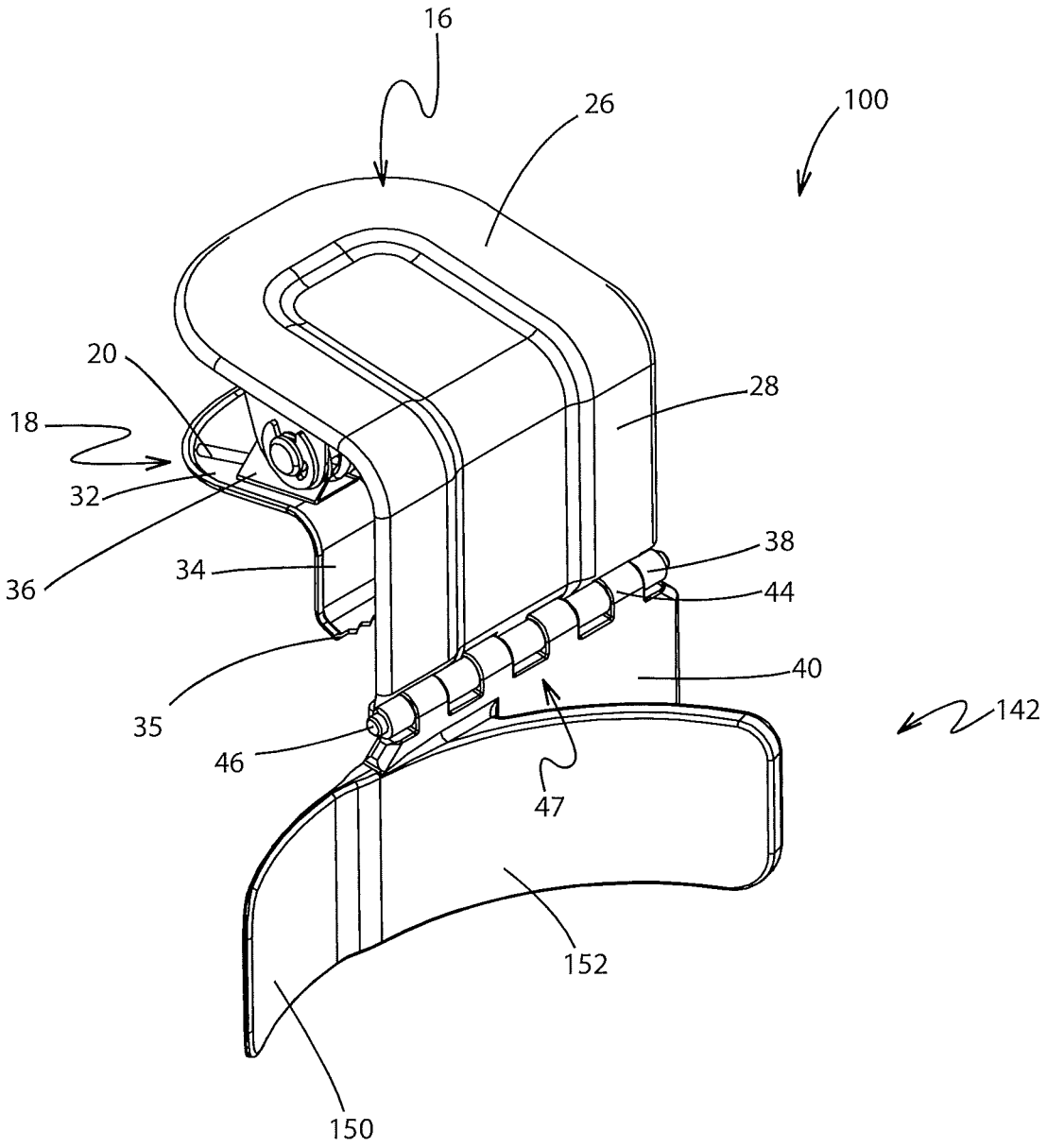
FIG. 7 is a top perspective view of a third embodiment of a hockey training device in accordance with present disclosure having a connector assembly with projections thereon and showing a different version of the puck holding assembly.

Young hockey players may not have sufficient strength to cause puck 2 to accelerate to a sufficient degree to cause first section 50 of cup assembly 42 to flatten out against blade 3 when a wrist shot is played. Second section 54 and middle section 52 may be responsible for about 90% of the positioning of puck 2 on blade 3, especially, during motion of the player. The hockey training device can be varied to ensure young players can use the training device to their advantage. FIG. 7 through to FIG. 9 shows different versions of the cup assembly that has a shortened C-shaped profile to make it easier for young players to use the training device.

Referring to FIG. 7, there is shown a third embodiment of hockey training device 100. The device 100 is substantially identical in structure and function to device 60 except that cup assembly 142 is differently configured to cup assembly 42. In particular, cup assembly 142 comprises a first section 150 and a middle section 152. Second section 54 is omitted from cup assembly 142.

Figure 8:
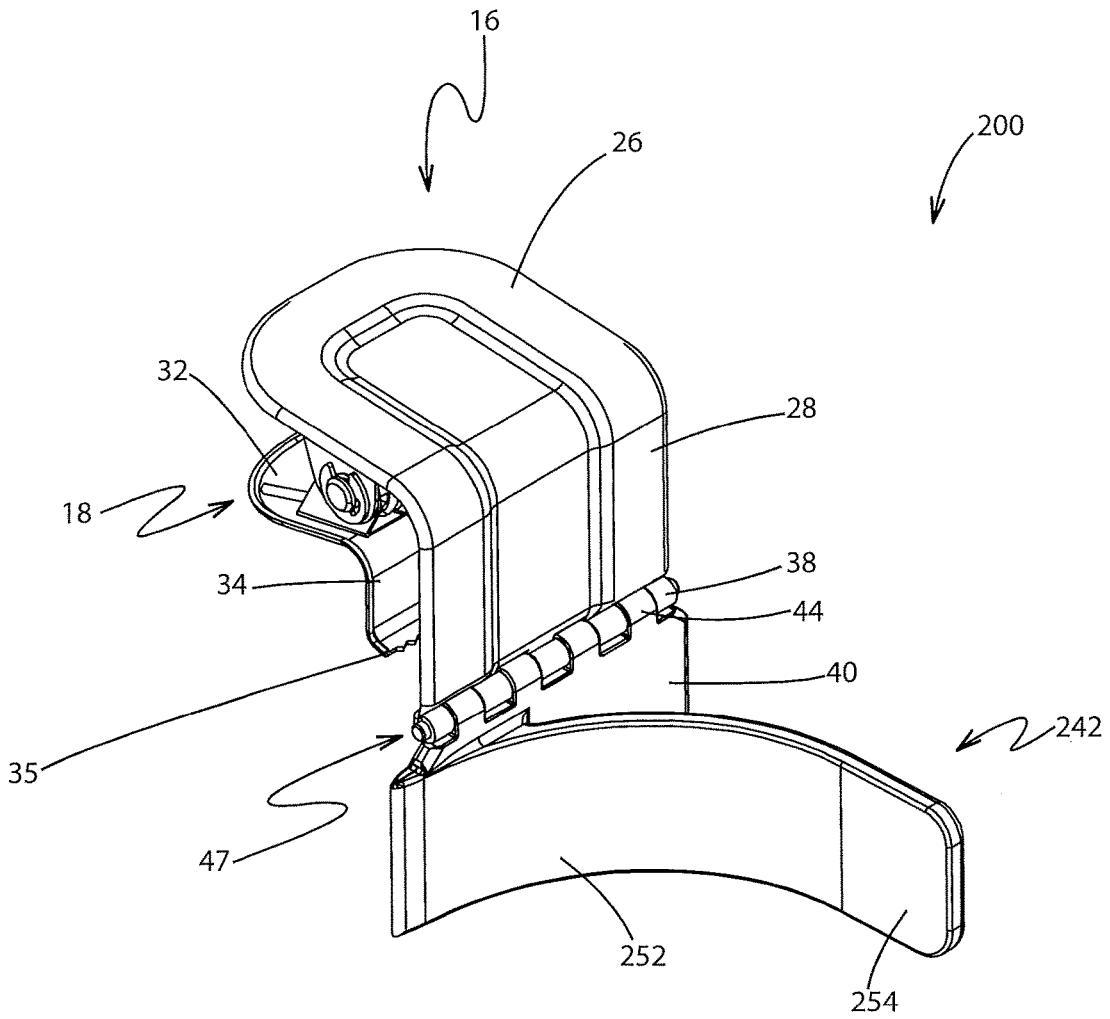
FIG. 8 is a top perspective view of a fourth embodiment of a hockey training device in accordance with present disclosure showing the connector assembly with projections thereon and having a further version of the puck holding assembly.

Referring to FIG. 8, there is shown a fourth embodiment of hockey training device 200. The device 200 is substantially identical in structure and function to device 60 except that cup assembly 242 is differently configured to cup assembly 42. In particular, cup assembly 242 comprises a middle section 252 and second section 254. First section 50 is omitted from cup assembly 242.

Figure 9:
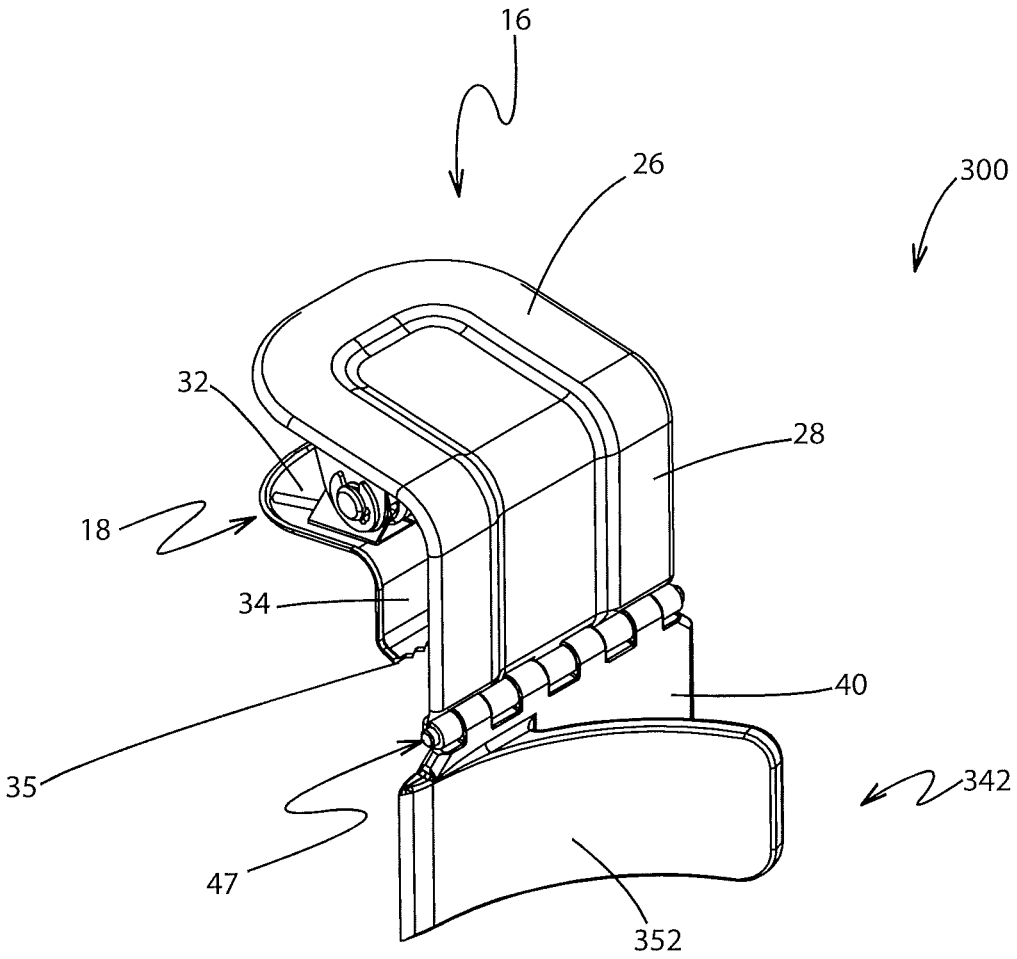
FIG. 9 is a top perspective view of a fifth embodiment of a hockey training device in accordance with present disclosure showing the connector assembly with projections thereon and having another variation of the puck holding assembly.

Referring to FIG. 9, there is shown a fifth embodiment of hockey training device 300. The device 300 is substantially identical in structure and function to device 60 except that cup assembly 342 is differently configured to cup assembly 42. In particular, cup assembly 342 comprises only a middle section 352. First section 50 and second section 54 are omitted from cup assembly 342.

FIGS. 10 to 15 illustrate operational views of how to make a wrist shot using hockey training device 10 in accordance with the current disclosure. In order to play a wrist shot, the puck needs to be stationary relative to the blade and be positioned about four inches from the heel. The hockey player may be stationary or moving across ice when the wrist shot is played. The wrist shot starts with the player tilting the stick from the vertical through an angle about 25 degrees. The player sweeps the blade across ice and towards a net or another player. For the young players learning to correctly position the puck and learning how to hold the puck in stationary may be very difficult. The training device 10 may be useful to teach young players how to capture puck 2, to position puck 2 correctly on blade 3, and to hold puck 2 stationary prior to making a shot.

Figure 10:
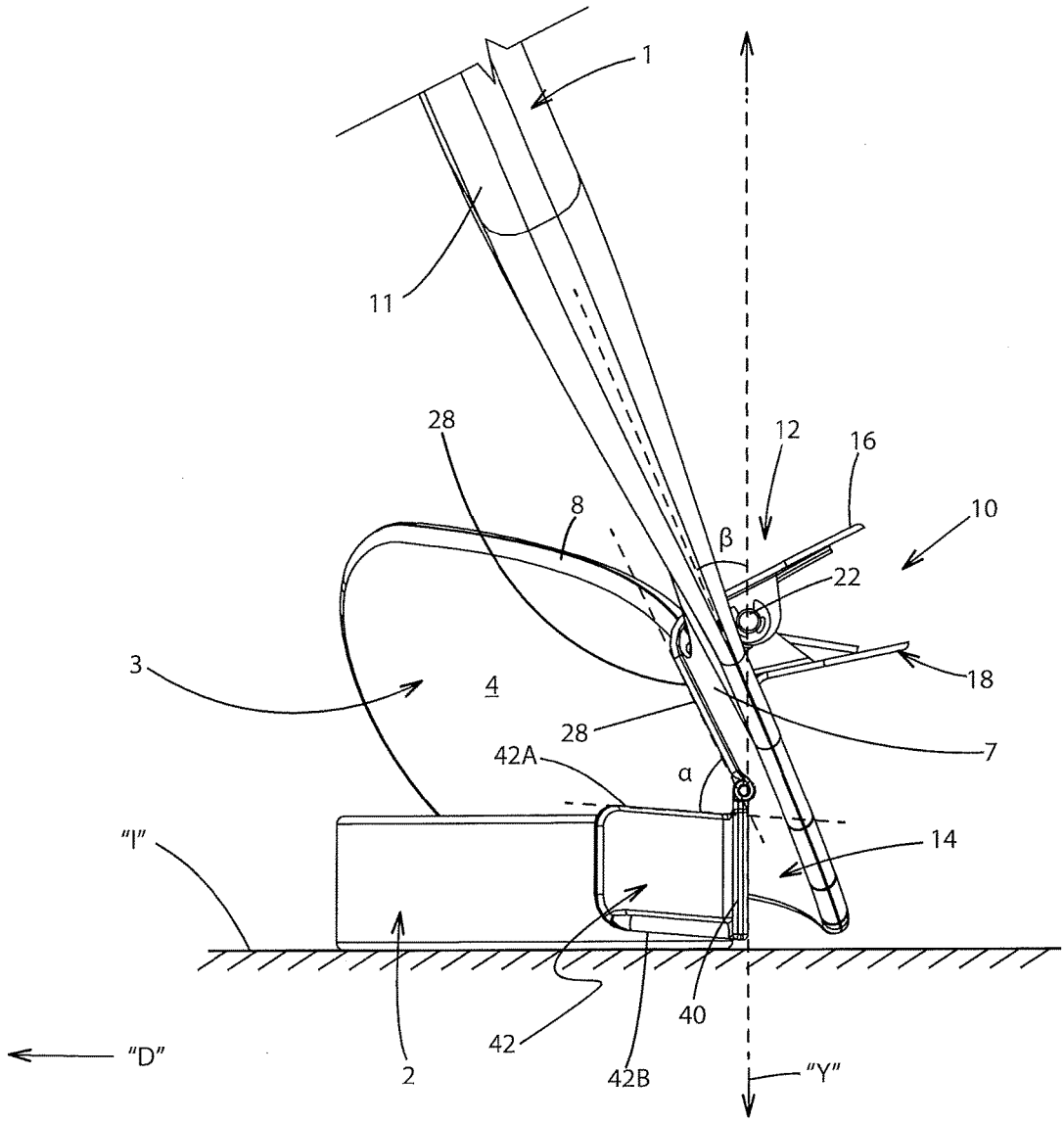
FIG. 10 is a right side elevation view of the first embodiment of the hockey training device mounted on a hockey stick blade, where the blade is oriented in a first position, and showing a puck located inside of a puck holding assembly, and wherein the cup assembly of the puck holding assembly is positioned substantially perpendicular to the ice.
Figure 11:
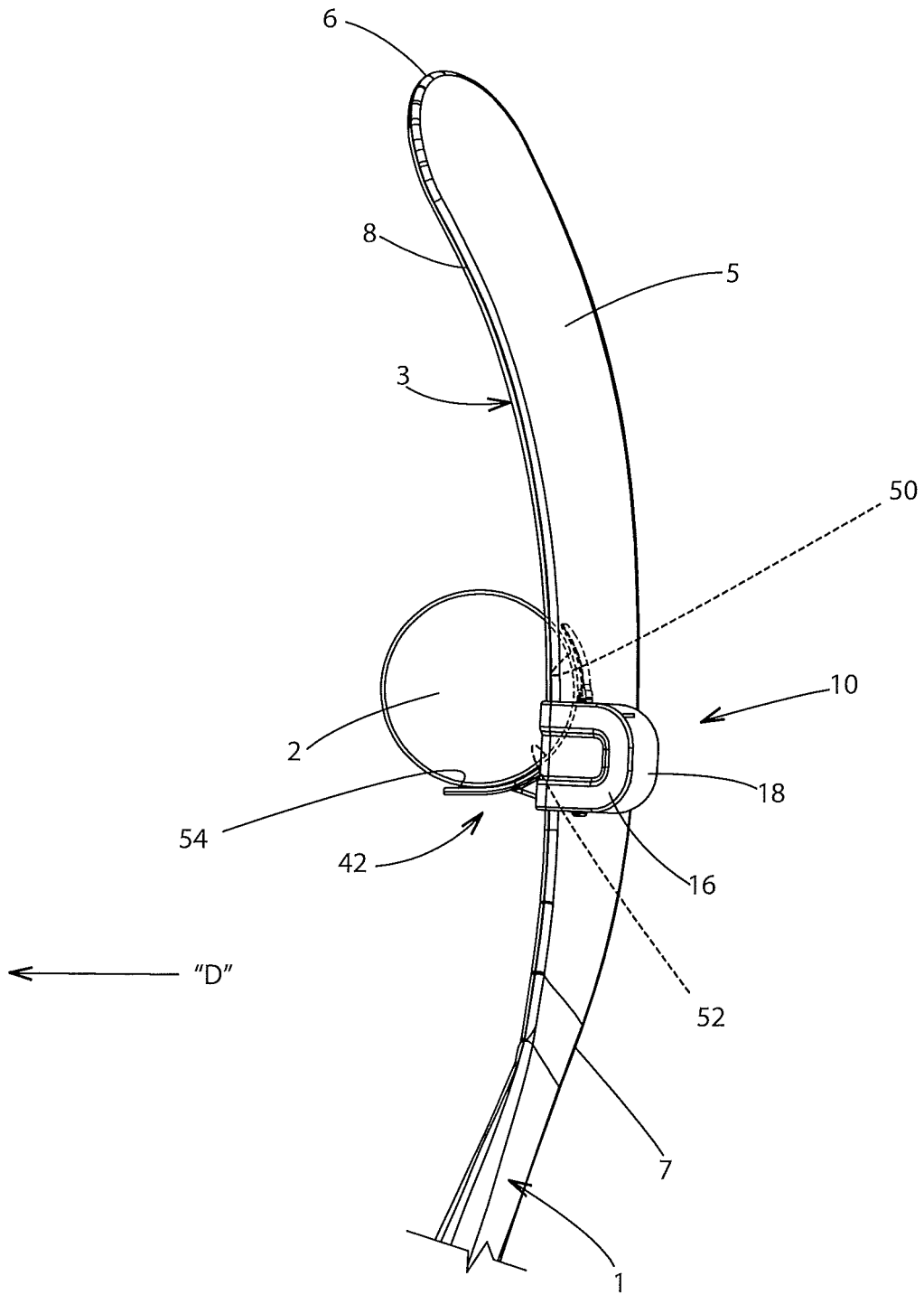
FIG. 11 is a top plan view of the first embodiment of the hockey training device shown in FIG. 10.

As shown in FIGS. 10 and 11, device 10 is fixedly engaged with blade 3 of stick 1 by pinching the free ends of first bracket 16 and second bracket 18 together and receiving top edge 8 of blade 3 between rubber grip 35 and rear surface of second leg 28. When the free ends of first bracket 16 and second bracket 18 are released, blade 3 is clamped between second leg 28 of first bracket 16 and second leg 34 of second bracket 18. Clamp 12 can be positioned at any height on blade 3 by adjusting the position of clamp 12 relative to top edge 8 of blade 3. This height adjustability of clamp 12 allows a user to engage hockey training device 10 on wide variety of different blades. When clamp 12 is engaged with blade 3, clamp 12 extending outwardly from second face 5 of blade 3 may not noticeably project above top edge 8 of blade 3, and therefore may not present a safety concern for players.

As shown in FIGS. 10 and 11, hockey puck 2 is placed on ice "I" and cup assembly 42 is positioned to capture puck 2 as shown in FIG. 11. Stick 1 is titled forwardly through an angle of $\beta$ relative to vertical axis "Y" (as shown in FIG. 10) so that top edge 8 of blade 3 is tilted forwardly as well. The angle $\beta$ may be about 25 degrees. FIG. 10 shows an arrow "D" indicating a direction in which puck 2 is to be played. When stick 1 is tilted, the player cannot fully see puck 2. Second section 54 of cup assembly 42 prevents puck 2 from moving toward heel 7, and assembly 42 holds puck 2 stationary relative to blade 3.

Figure 12:
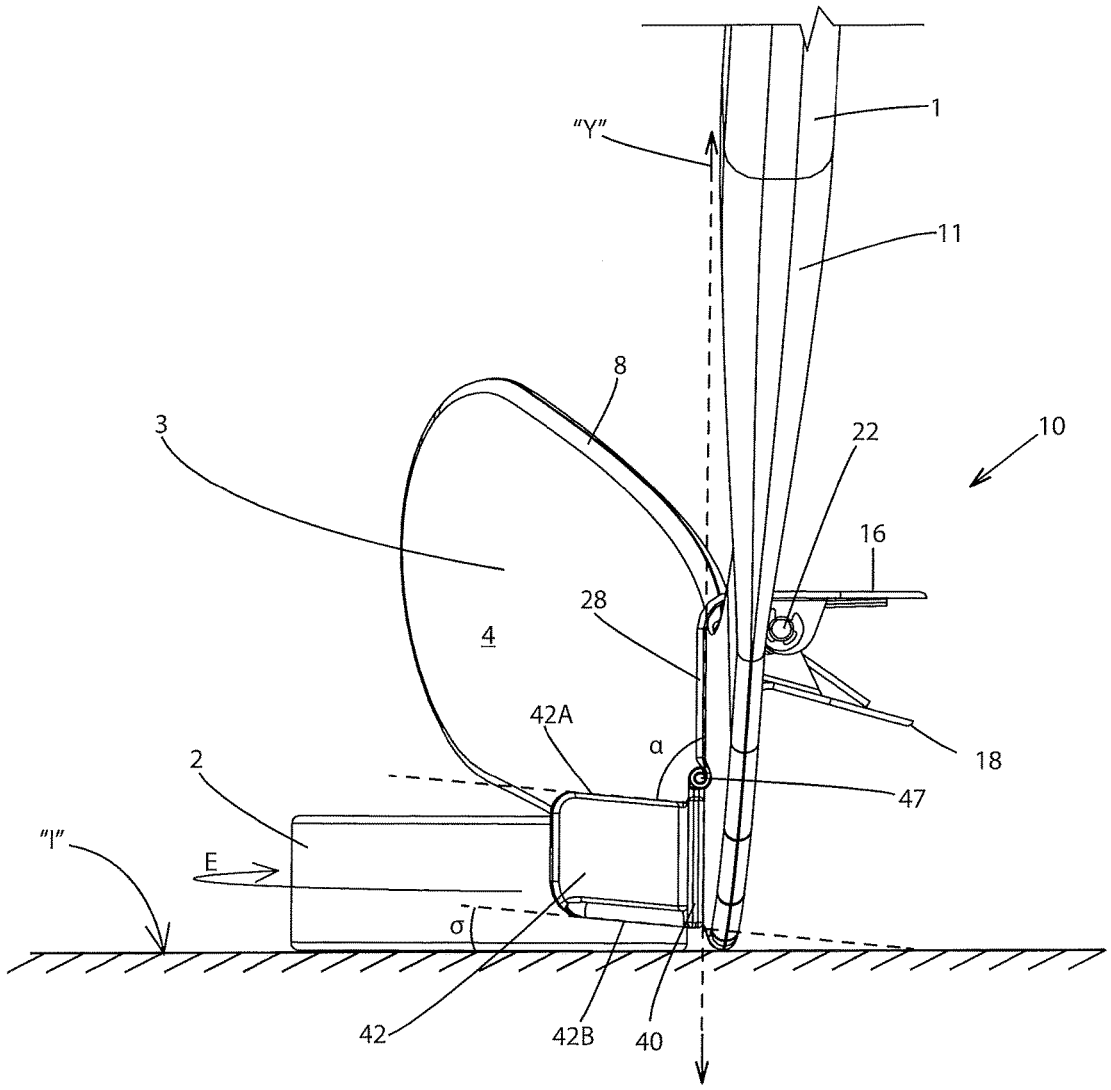
FIG. 12 is a right side elevation view of the first embodiment of the hockey training device mounted on the hockey stick blade, where the blade is oriented in a second position, and wherein the cup assembly is oriented substantially parallel to the hockey stick face while maintaining its orientation relative to the ice surface.
Figure 13:
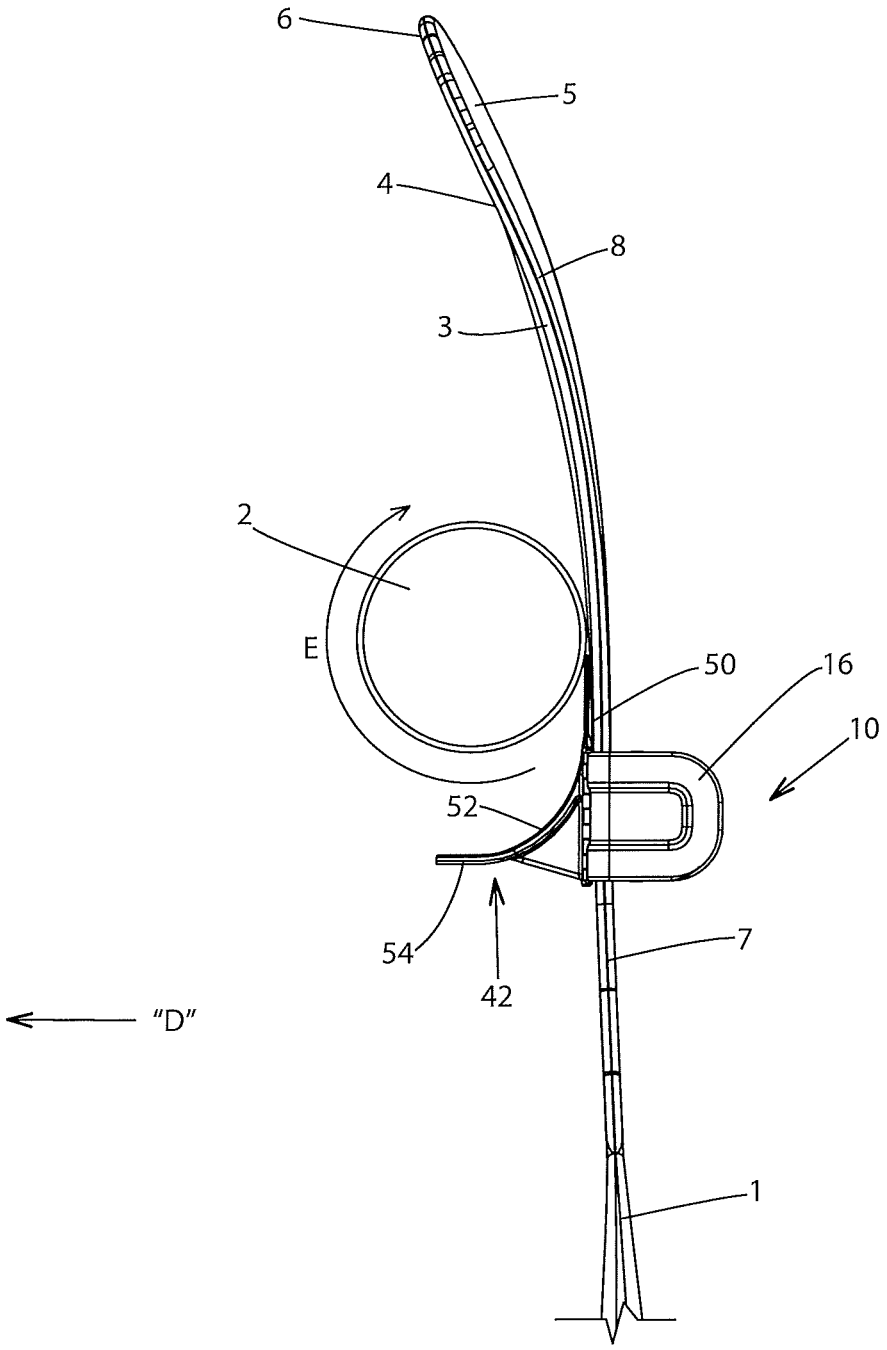
FIG. 13 is a top plan view of the hockey training device of FIG. 12, wherein the puck is shown leaving the cup assembly and moving the flexible first section of the cup assembly to a position where the first section is substantially parallel to and contacting the first face of the blade.

The player sweeps blade 3 cross ice "I" in the direction indicated by the arrow "D" (FIGS. 12 and 13). FIGS. 12 and 13 also show the positioning of stick 1 as the player starts to make the wrist shot. As the shot is played, a shaft 11 of stick 1 moves though a position that is perpendicular to ice "I" and puck 2 is fully observable from a top view (as shown in FIG. 13). Simultaneously, puck 2 rotates in direction "E" (FIGS. 12 and 13) and moves outwardly from cup assembly 42 and towards toe 6 of blade 3; rolling over first section 50 of cup assembly 42 as it moves towards toe 6. The force of making the shot causes puck 2 to roll along first section 50, flattening section 50 against first face 4 of blade 3. First section 50 therefore moves from a first position shown FIG. 11 to a second position shown in FIG. 14. The acceleration forces at approximately the vertical position of stick 1 keeps puck 2 at about 90 degrees to blade 3 to control the launch angle of puck 2, and its straightness in flight. At the same time, second leg 28 of clamp 12 pivots about hinge 47 and relative to plate 40. In particular, second leg 28 of clamp 12 may pivot through the angle β relative to plate 40. Consequently, second leg 28 may be oriented at angle α relative to the top edge 42A of cup assembly 42. Plate 40 may be oriented perpendicular to ice "I". When comparing FIG. 10 and FIG. 12, the orientation of cup assembly 42 relative to ice "I" tends to remain unchanged and blade 3 will tend to continue to remain in contact with ice "I" or remain almost in contact therewith. If the device 10 did not have a pivoting function between plate 40 and cup assembly 42, puck 2 could tend not to be fully engaged with cup assembly 42.

Figure 14:
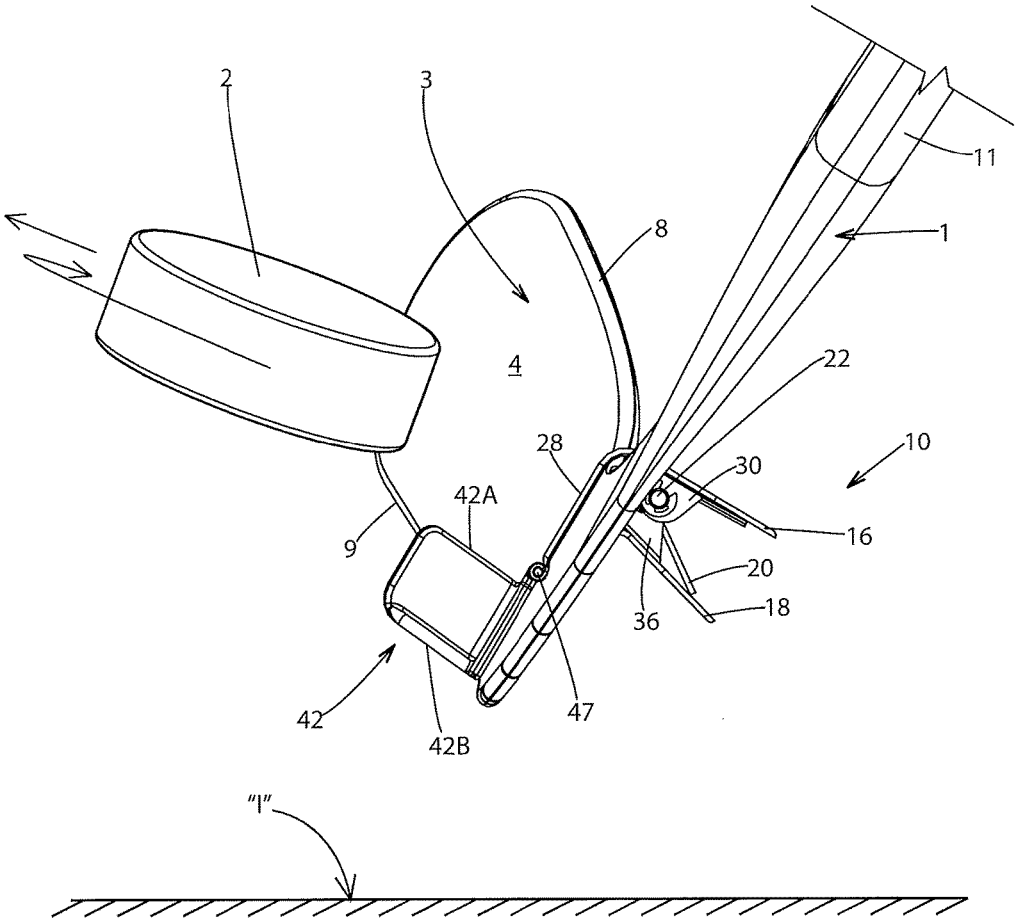
FIG. 14 is a right side elevation view of the hockey training device showing the puck exiting the puck holding assembly as the shot is made.
Figure 15:
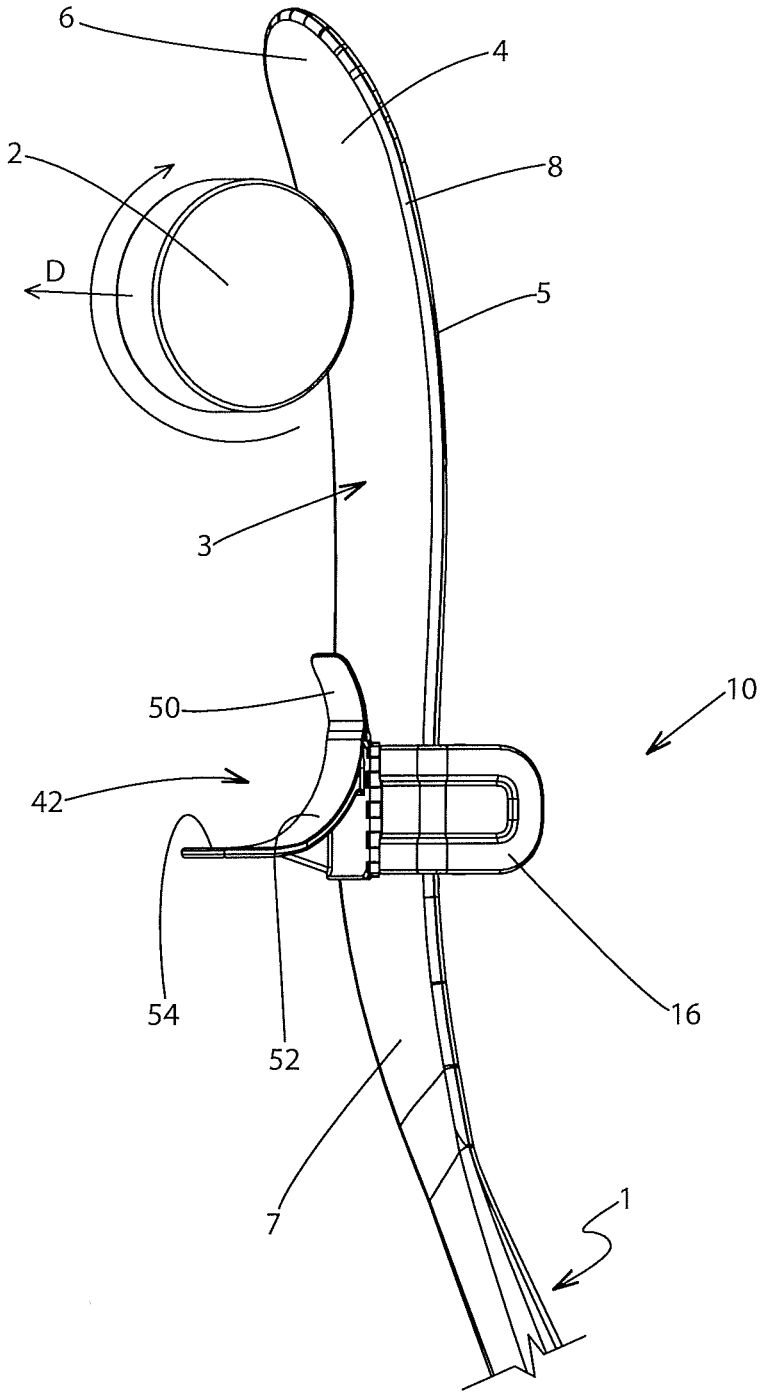
FIG. 15 is a top plan view of the hockey training device shown in FIG. 14.

As depicted in FIGS. 14 and 15, as the player continues to play the shot, shaft 11 of stick 1 moves past vertical and therefore blade 3 and puck 2 lift off ice "I". Puck 2 is released from stick and flies toward a net or another player. The angle of blade 3 dictates the trajectory of puck 2. As shown in FIG. 15, once puck 2 rolls past the end of first section 50, first section 50 returns to the first position.

Figure 16:
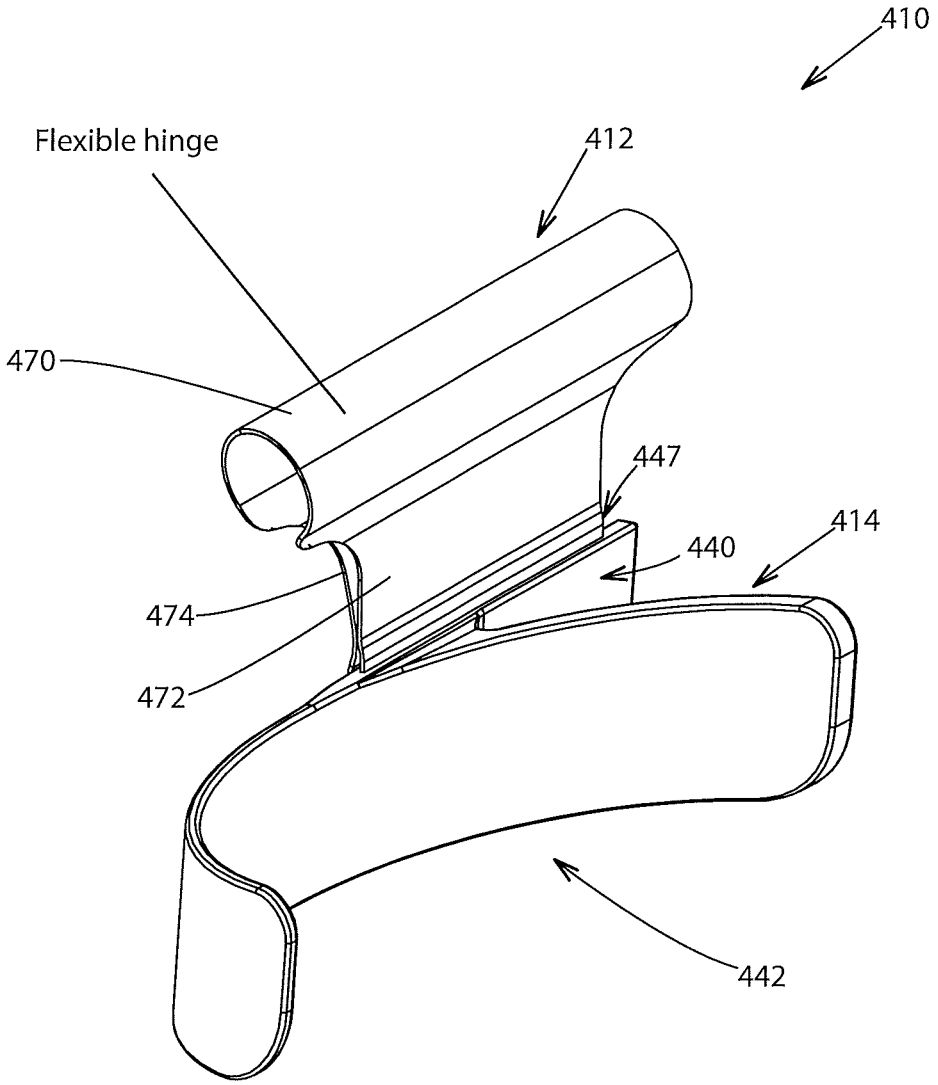
FIG. 16 is a top perspective view of a sixth embodiment of a hockey training device in accordance with the present disclosure showing a clip-type connector assembly.
Figure 17:
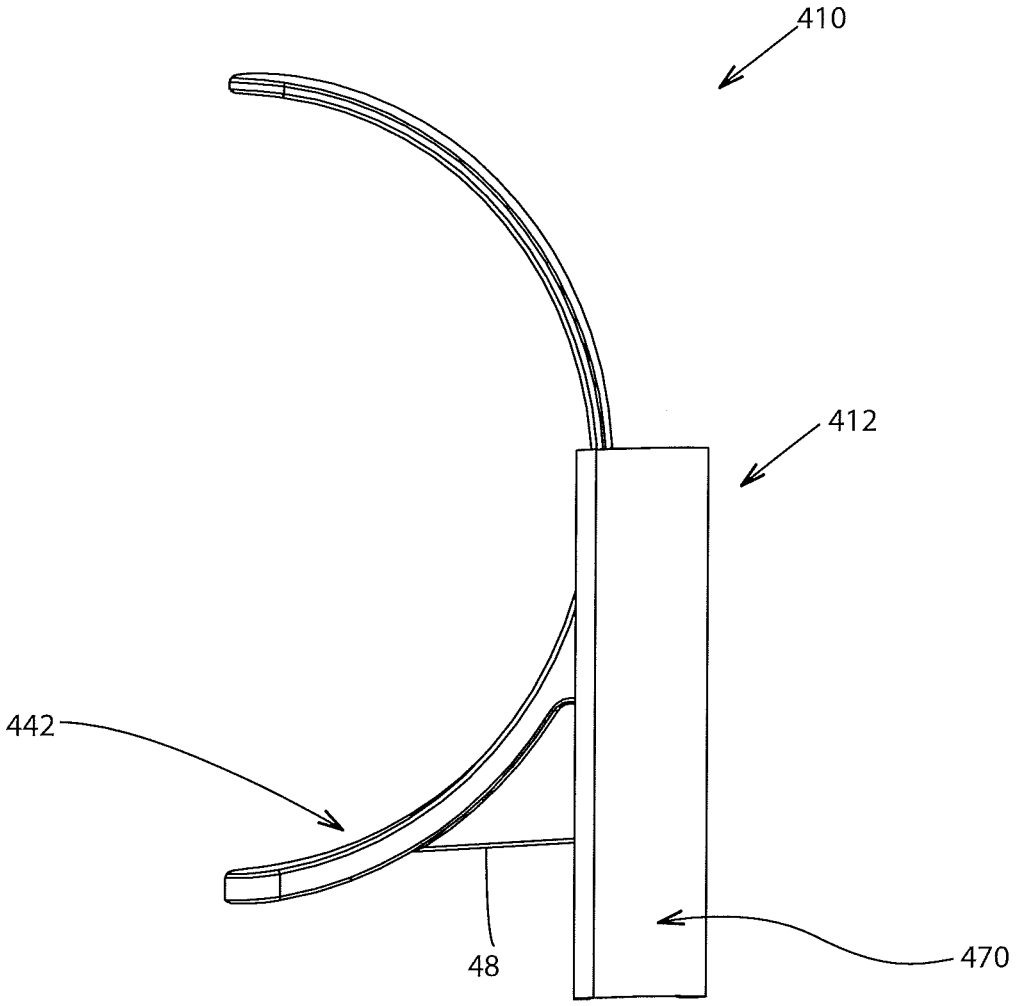
FIG. 17 is top plan view of the hockey training device of FIG. 16.
Figure 18:
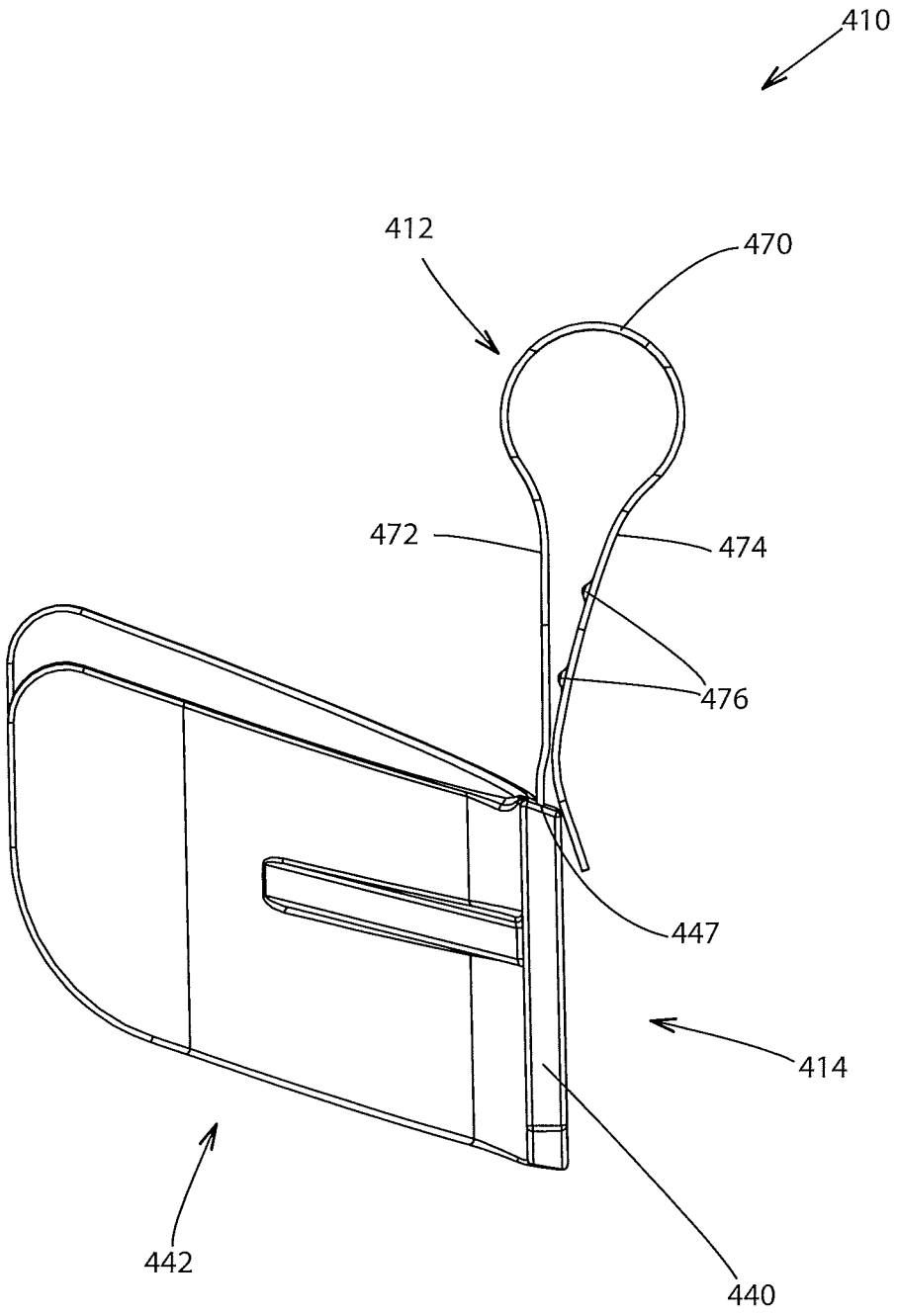
FIG. 18 is a right side elevation view of the hockey training device of FIG. 16.

As shown in FIGS. 16 and 18, a sixth embodiment of the hockey training device 410 comprises a connector assembly 412, a puck holding assembly 414, and a hinge 447. The puck holding assembly 414 may be substantially identical to any of the puck holding assemblies 14, 114, 214, 314 described herein. The connector assembly 412 differs from the previously described connector assemblies 12, 112, 212, 312 and hinge 447 differs from the previously described hinges 47, 147, 247 and 347. The connector assembly 412 may comprise a clamping device in the form of a spring clip 470. Spring clip 470 may include a first arm 472 and a second arm 474. As shown in FIG. 18, the second arm 474 may be biased toward the first arm 472. One or more projections 476 (or rubber grip) may be provided on a front surface of second arm 474. When spring clip 470 is opened and positioned over top edge 8 of blade 3, projections 476 will contact the second face 5 of blade 3 and help hold the spring clip 470 in place on blade 3.

The hinge 447 may comprise a living hinge that is integrally formed with the first arm 472 of the clip 470 or with a plate 440 of the cup assembly 442. The living hinge 447 may simply comprise a line of weakness formed toward a bottom end of first arm 472 and which permits first arm 472 and thereby the rest of spring clip 470 to move (i.e., pivot) relative to the cup assembly 442. Hockey training device 410 may be used in much the same manner as has been described above with respect to hockey training device 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A hockey training device comprising:
a connector assembly adapted to engage a blade of a hockey stick; and
a puck holding assembly;
a hinge provided between the connector assembly and the puck holding assembly; wherein the hinge permits the puck holding assembly and the connector assembly to pivot relative to each other.

2. The hockey training device of claim 1, wherein the connector assembly is a clamp.

3. The hockey training device of claim 2, wherein the hinge is a mechanical hinge that includes a pin, and wherein the puck holding assembly or the connector assembly pivots about an axis that extends along the pin.

4. The hockey training device of claim 2, wherein the clamp includes a leg adapted to be oriented generally parallel to a first face of the blade of the hockey stick; and wherein the hinge includes a pin that is oriented parallel to the leg of the clamp.

5. The hockey training device of claim 4, wherein the pin is in a same plane as the leg of the clamp.

6. The hockey training device of claim 1, wherein the hinge is a living hinge.

7. The hockey training device of claim 2, wherein the clamp comprises:
a first bracket; a second bracket; and
a torsion spring engaged with the first bracket and the second bracket; and wherein the torsion spring permits movement of the second bracket relative to the first bracket.

8. The hockey training device of claim 7, wherein the hinge rotatably engages the puck holding assembly to the first bracket.

9. The hockey training device of claim 1, wherein the puck holding assembly comprises a plate and a cup assembly.

10. The hockey training device of claim 9, wherein the plate of the puck holding assembly is engaged with the connector assembly by a hinge.

11. The hockey training device of claim 10, wherein the cup assembly is generally C-shaped when viewed from above.

12. The hockey training device of claim 11, wherein the cup assembly comprises a first section, a middle section and a second section; wherein the middle section is operably engaged with the connector assembly and the first section extends forwardly from the middle section and the second section extends rearwardly from the middle section.

13. The hockey training device of claim 12, wherein the first section is flexible and is movable between a first position and a second position relative to the middle section.

14. The hockey training device of claim 12, wherein the cup assembly has a thickness measured between an interior surface and an exterior surface; and wherein the thickness of the first section is smaller than the thickness of the second section.

15. The hockey training device of claim 13, wherein the second section is substantially rigid.

16. The hockey training device of claim 9, wherein the connector assembly includes a leg adapted to be oriented generally parallel to a first face of the blade of the hockey stick; and wherein the cup assembly is oriented at an angle relative to the leg of the connector assembly.

17. In combination a hockey stick and a hockey training device, wherein
the hockey stick includes a blade at an end of a handle; wherein the blade has a first face and an opposed second face; and the hockey training device comprises a connector assembly and a puck holding assembly operably engaged with the connector assembly; wherein the connector assembly is engaged with the blade of the hockey stick; and a hinge is positioned between the connector assembly and the puck holding assembly; wherein the hinge permits the puck holding assembly and the connector assembly to pivot relative to each other.

18. The combination of claim 17, wherein the connector assembly includes a leg that is positioned generally parallel to the first face of the blade when the connector assembly is engaged with the blade; and wherein the puck holding assembly is secured to the leg by the hinge.

19. The combination of claim 18, wherein the puck holding assembly includes a cup assembly and wherein the cup assembly is oriented at an acute angle relative to the leg of the connector assembly.

20. The combination of claim 17, wherein the connector assembly is a clamp.

21. The combination of claim 20, wherein the clamp comprises:

a first bracket;

a second bracket; and wherein the second bracket is nested within the first bracket; and a torsion spring engaged with the first and second bracket; and wherein each of the first and second brackets is L-shaped and a leg of the first bracket is oriented substantially parallel to the first face of the blade; and a second wall of the first bracket is oriented at right angles to the first face of the blade.

22. A method of training a hockey player using a hockey training device, said method comprising steps of:

providing a hockey stick having a handle and a blade;

providing a hockey training device comprising a connector assembly and a puck holding assembly movably engaged with the connector assembly by a hinge;

providing a hinge between the connector assembly and the puck holding assembly;

placing the connector assembly on the blade of the hockey stick;

extending the puck holding assembly outwardly from a first face of the blade;

capturing a hockey puck in the puck holding assembly;

playing a shot with the hockey stick;

pivoting the puck holding assembly relative to the connector assembly as the shot is played; and releasing the hockey puck from the puck holding assembly.

23. The method of claim 22, further comprising:

maintaining contact between the blade and an ice surface during the step of playing the shot.

24. The method of claim 22, further comprising:

adjusting a height of the connector assembly relative to a top edge of the blade.

25. The method of claim 22, wherein the connector assembly includes projections or a rubber grip and wherein the method further comprises:

contacting a second face of the blade with the projections or rubber grip.

26. The method of claim 22, wherein the puck holding assembly includes a C-shaped cup assembly comprising a middle section engaged with the connector assembly; a first section extending forwardly from the middle section and a second section extending rearwardly from the middle section; and wherein the step of playing the shot further comprises:

rolling the puck forwardly from the second section towards the first section; and moving the first section from a first position to a second position; and orienting the first section generally parallel to the first face of the blade when the first section is moved to the second position.

27. The method of claim 22, further comprising:

engaging the connector assembly on the blade such that the hinge is positioned generally at puck height from the ice when a bottom edge of the blade is placed on the ice.

28. The method of claim 22, further comprising:

pivoting the puck assembly when the shot is maintaining contact holding assembly upwardly relative to the connector played; and maintaining contact between a bottom edge of the blade and the ice.

* * * * *